United States Patent [19]

Radford

[11] 4,160,313

[45] Jul. 10, 1979

[54] METHOD OF MAKING A WAX PATTERN FOR A SHELL MOULD

[75] Inventor: William H. Radford, Littleover, England

[73] Assignee: Rolls-Royce Limited, London, England

[21] Appl. No.: 862,561

[22] Filed: Dec. 20, 1977

Related U.S. Application Data

[63] Continuation-in-part of Ser. No. 725,154, Sep. 21, 1976, abandoned.

[30] Foreign Application Priority Data

Sep. 25, 1975 [GB] United Kingdom ..... 39238/75

[51] Int. Cl.[2] ..... B23P 19/02

[52] U.S. Cl. ..... 29/525; 29/526 R; 164/45; 164/249; 264/219

[58] Field of Search ..... 29/423, 458, 526, 525; 164/45, 249; 264/219

[56] References Cited

U.S. PATENT DOCUMENTS

| | | | |
|---|---|---|---|
| 445,859 | 2/1891 | Paul | 164/249 |
| 573,970 | 12/1896 | Gartside | 164/249 |
| 949,611 | 2/1910 | Berg | 164/249 |
| 1,291,221 | 1/1919 | Spellman | 164/249 |
| 1,426,621 | 8/1922 | Walther | 164/249 |
| 2,451,747 | 10/1948 | Kindt | 164/249 |
| 3,985,176 | 10/1976 | Wamester | 164/45 |

FOREIGN PATENT DOCUMENTS

| | | | |
|---|---|---|---|
| 264675 | 2/1950 | Switzerland | 164/45 |
| 1171594 | 11/1969 | United Kingdom | 164/249 |

*Primary Examiner*—Charlie T. Moon

*Attorney, Agent, or Firm*—Cushman, Darby & Cushman

[57] ABSTRACT

A wax former and runner are moulded with complementary stud and socket members included in the respective moulds. The former and runner are then assembled simply by pressing stud into socket, thus avoiding loss of dimensional accuracy which would have occurred, had interface melting been employed.

7 Claims, 3 Drawing Figures

METHOD OF MAKING A WAX PATTERN FOR A SHELL MOULD

This application is a continuation-in-part application of U.S. application Ser. No. 725,154, filed Sept. 21, 1976, now abandoned.

This invention concerns a method of and apparatus for making a pattern for use in the investment casting process and apparatus therefor.

Heretofor, the accepted method of making a wax pattern comprised moulding separate former and runner, then prior to dipping the whole into a shell forming substance locating the former against the runner and passing a hot wire or knife blade through the interface therebetween, so as to fuse the two together into a pattern. At best this is a time consuming action. However, a more serious effect is the unavoidable removal of wax at the interface, with resultant loss of dimensional stability. This deflects the main reason for using the investment casting process i.e. to achieve great dimensional accuracy in 'as cast' part.

There is no relevant prior art in the investment casting field, which is known to applicant. However, prior art in the casting field generally i.e. cores laid in foundry sand, provides no intimation of how former and runner may be connected and the convection maintained, without the support of the mould material. For example Swiss Pat. No. 264675 of Oct. 31, 1949 discloses two halves of a chain link pattern, which are in register via integral spigots and sockets. However, the pattern material is mercury and the halves are supported together by foundry sand. Clearly the spigot connection is merely for relative positional location, in a given attitude. They do not and neither is there any indication, that they should grip each other.

Other art, such as U.S. Pat. No. 949,611 dated February 1910 depicts the fastening together of two mould box halves, via separately applied press studs and sockets. However, there is no teaching of applying such a principle to the pattern which in operation, the box will contain. It is one object of this invention to obviate the necessity for melting the wax interface.

The present invention comprises a method of making a wax pattern for a shell mould including the steps of moulding at least one wax former with a first portion of a connector embedded in the one or each one, moulding a wax runner with at least one further connector portion embedded therein, said further connector portion or portions being complementary to said first at least one connector portion and adapted for locking thereto removing the solidified former and runner mouldings from their moulds then locking them former to runner, by said first and further connector portions, to complete the pattern.

The invention includes apparatus for putting the method of making a wax pattern for a shell mould into effect and comprises a former mould box adapted for the receipt of at least one connector portion, said at least one connector portion, a runner box adapted for the receipt of at least one further connector portion complementary to said first at least one connector portion and said further connector portion or connector portions, the connector being arranged in their respective boxes such that on said boxes being filled with wax, said connector portions are retained in the wax in a manner which permits the resulting former and runner to be joined thereby to make a pattern.

Preferably said connector portions are made from a thermo plastic material.

The invention further includes at least one former and connector portion, said connector portion being adapted for co-operation with a further connector portion and be means of which in operation said at least one former may be joined to a runner to make a pattern.

The invention further comprises a runner and connector portion, said connector portion being adapted for co-operation with a further connector portion and by means of which in operation, said runner may be joined to a former to make a pattern.

The invention will now be described by way of example, with reference to the accompanying drawings in which.

Figure 1:
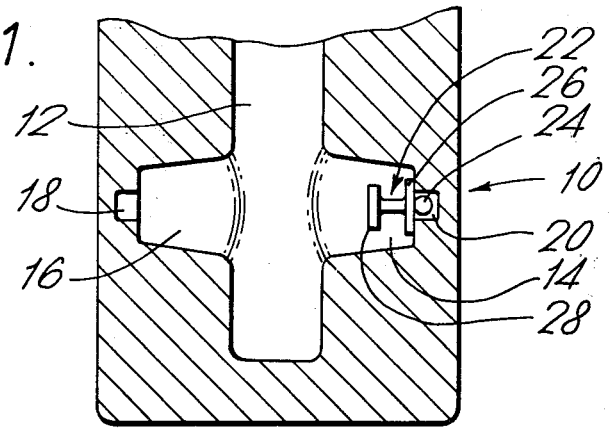
FIG. 1 is a cross-sectional part view of a wax runner moulding box.

In FIG. 1 a mould box for a wax runner is indicated by the numeral 10. The box provides a long central compartment 12 which in a casting operation will contain the runner wax. Branches 14, 16 off each side of the runner compartment provide respective riser compartments, which risers in operation, form stems on to the ends of which, wax formers will be located prior to dipping of the whole into a frit substance as is known in the art.

Each riser compartment 14, 16 has a respective recess 18, 20 in its end face and a connector in the form of a plastic stud 22 is fitted therein via one of its ends 24 which is spherical and slightly larger in diameter than the bore of the recess 20 so as to be retained by an interference fit.

Each stud 22 has a shoulder 26 adjacent the spherical end 24, which acts as part of the end face of an eventual riser on the wax runner to be formed. A further shoulder 28 is provided at that end of the stud remote from end 24 for complete envelopment by wax, to act as a key to lock the stud against extraction from the runner to be formed.

Only one stud 22 is shown but it should be appreciated that the number of such studs will equal the number of risers to be produced on the runner.

Figure 2:
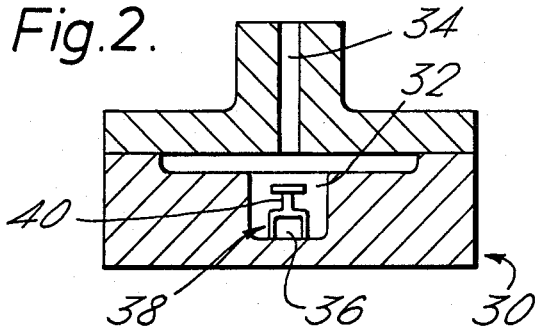
FIG. 2 is a cross-sectional view of a wax former moulding box.

Referring now to FIG. 2. A former moulding box is indicated by the numeral 30. The former is cast in the space 32 from molten wax which is poured in there via channel 34. A spigot 36 is provided on the bottom of the mould and a connector in the form of a plastic socket member 38 having a shouldered stem 40 is fitted thereover as shown in the drawing. The arrangement is such that in the finished moulded former, the rim of the member is flush with an end face of the former and the shouldered portion of the stem is totally enveloped by wax, thus preventing extraction of the member from the former.

In the present example both stud and socket members are made from polypropylene which will melt at a temperature higher than the temperature at which the moulds are dewaxed (approx 100° C.) but lower than the pre-heating temperature of approx 900° C. of the dip coated shell which will eventually be formed around both runner and former, prior to the shell being cured in known manner.

It has been found that some of the studs fall out of the shell with the molten wax and it follows that it is possible to make the studs from a material which will not melt and the weight of which may be such as to ensure that they fall out with the molten wax thus making them reusable.

Figure 3:
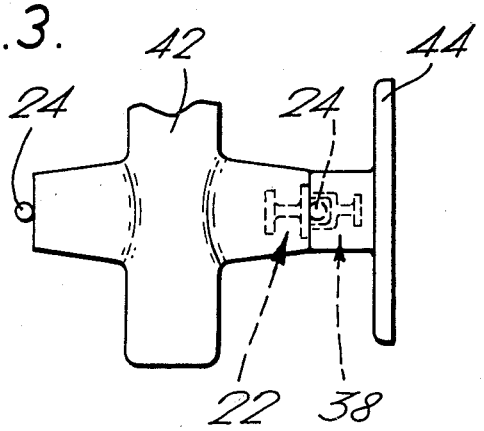
FIG. 3 is a view of a complete pattern in accordance with an aspect of the invention.

FIG. 3 depicts a runner 42 which has been moulded in box 10 joined to a former 44 which has been moulded in box 30 to make a complete pattern. The joining of the runner 42 and the former 44 is effected simply by pressing the spherical projection 24 of stud 22 into the socket of the member 40, so that they become locked together by virtue of the interference fit, thus obviating the step of melting and fusing the wax interface of runner and former.

It will be appreciated that dependent upon the size of the former, one or more such fastenings can be incorporated in runner and former. It may be found that on pressing the stud into the socket, the wax which surrounds the socket fractures, which fracture would be due to the brittle wax being subjected to loads radially of the socket. The problem can be overcome by first inserting the stud in the socket, then moulding this sub-assembly into the former with the stud free end protruding from the former. Afterwards the stud is pulled out of the socket in the former, which allows the socket to regain its shape and the stud is then moulded into the runner riser. The former is joined to the runner by refitting the stud into the socket, which has room to expand in its former through the interference fit of the stud. Alternatively, another identical stud could be moulded into the runner riser, the first stud wisely being used to pre-stress the socket connector when the former is being moulded.

If more than one fastening is necessary, the fastening will be restricted to a press fit type described and illustrated. However, if only one fastening is necessary, it may be possible to utilise a screwed stud and socket member, the screw threads being moulded into the plastic at the time of manufacture of stud and member. However, the arrangement illustrated and described is the most simple and rapid to operate.

I claim:

1. A method of making a wax pattern for a shell mould including the steps of:

moulding at least one wax former with a first portion of a connector embedded in the at least one former, separately moulding a wax runner with at least one further portion of the connector embedded therein and partially projecting therefrom, said at least one further portion of the connector being complementary to and lockable in said at least first portion of the connector, removing the solidified former and runner mouldings from their moulds, then locking the former to the runner by inserting the complementary said further portion of the connector into said first portion of the connector to provide a joint at the interface between the former and the runner.

2. A method of making a wax pattern for a shell mould as claimed in claim 1 including the step of press fitting by an interference fit the complementary first portion and further portion of the connector together so as to achieve said locking and to complete the pattern.

3. A method as claimed in claim 2 wherein the at least one wax former is moulded with the first portion of the connector being a socket and the socket has the second portion of the connector in the form of a stud locked therein by an interference fit so as to pre-stress the socket wall, then removing the stud from the socket in the former and joining the former to the runner by inserting the further portion of the connector in the runner into the first portion of the connector in the former.

4. A method of making a wax pattern for a shell mould as claimed in claim 1 including the step of screwing the complementary first portion and the further portion of the connector together so as to achieve said locking and to complete the pattern.

5. A method of making a wax pattern from articles comprising a former and a runner for a shell mould including the steps of:

moulding one of the articles with a socket connector therein which has a stud locked into the socket connector by an interference fit so as to pre-stress the socket wall, the socket connector being positioned in the said one moulded article so that the free end of the stud projects from that face of the one moulded article which forms the interface with the other article on assembly of the pattern, then removing the stud from the socket of the one moulded article to relieve the stress on the socket wall, moulding the other of said articles with a stud partially projecting therefrom, and then joining the one moulded article with the other moulded article by inserting the stud of the other moulded article into the socket which has room to expand in the one moulded article.

6. A method as claimed in claim 5 including the step of reusing the stud used to pre-stress the socket wall when moulding the other of said articles.

7. A method as claimed in claim 5 wherein the stud moulded into the other of said articles is identical to the stud removed from the socket of the one of said articles.

* * * * *